US012553311B1

(12) United States Patent
Lindstrand et al.

(10) Patent No.: US 12,553,311 B1
(45) Date of Patent: Feb. 17, 2026

(54) BURST DISC SUB

(71) Applicant: Tryton Tool Services Limited Partnership, Edmonton (CA)

(72) Inventors: Tyler Lindstrand, Edmonton (CA); Randy Berryman, Edmonton (CA)

(73) Assignee: Tryton Tool Services Limited Partnership, Calgary (CA)

( * ) Notice: Subject to any disclaimer, the term of this patent is extended or adjusted under 35 U.S.C. 154(b) by 0 days.

(21) Appl. No.: 18/906,696

(22) Filed: Oct. 4, 2024

(51) Int. Cl.
*E21B 34/06* (2006.01)

(52) U.S. Cl.
CPC ..... *E21B 34/063* (2013.01)

(58) Field of Classification Search
CPC ..... E21B 34/063
See application file for complete search history.

(56) References Cited

U.S. PATENT DOCUMENTS 5,947,204 A 9/1999 Barton
6,472,068 B1 10/2002 Glass et al.
8,322,448 B2 * 12/2012 Brandsdal ..... E21B 34/063 166/376
9,732,579 B2 * 8/2017 Hiorth ..... E21B 33/12
11,603,726 B2 * 3/2023 Harris ..... E21B 33/12
11,713,649 B2 * 8/2023 Brandsdal ..... E21B 34/063 166/317
11,808,109 B1 11/2023 Conner et al.
11,851,968 B2 * 12/2023 Eriksen ..... E21B 33/12
12,037,872 B2 * 7/2024 Hiorth ..... E21B 33/1208
12,055,009 B2 * 8/2024 Driller ..... E21B 33/126
12,091,936 B2 * 9/2024 Stannus ..... E21B 7/20
12,209,480 B1 * 1/2025 Trahan ..... E21B 34/063
12,305,471 B2 * 5/2025 Eriksen ..... E21B 17/1078
12,359,526 B2 * 7/2025 Eriksen ..... E21B 34/063
2008/0271883 A1 11/2008 Barton et al.
2009/0250226 A1 10/2009 Al-Anazi
2017/0002943 A1 1/2017 Bunse et al.
2023/0243230 A1 * 8/2023 Eriksen ..... E21B 33/1208 166/179
2025/0137350 A1 * 5/2025 Bailey ..... E21B 34/063

* cited by examiner

*Primary Examiner* — Kenneth L Thompson
(74) *Attorney, Agent, or Firm* — Santosh K. Chari; CPST Intellectual Property Inc.

(57) ABSTRACT

A downhole tool is provided, which comprises burst or rupture disc sub for use in wellbore tubing strings is provided. The burst disc sub includes a frangible disc that, in the initial or closed state of the sub, prevents the flow fluids. The sub includes one or more breaking pins that are adapted to apply a radially inward force against the disc one the sub is pressurized, with such force being capable of shattering the disc and thereby place the sub in its open state.

13 Claims, 8 Drawing Sheets

BURST DISC SUB

CROSS REFERENCE TO PRIOR APPLICATIONS

Not applicable.

FIELD OF THE DESCRIPTION

The following description generally relates to oil well completion tools used for recovering hydrocarbons from subterranean resources. More particularly, the description relates to a burst disc sub that is adapted to initially block a tubing string and further adapted to be opened when desired.

BACKGROUND

In the field of hydrocarbon production, a wellbore is drilled into a hydrocarbon-containing subterranean formation, and a tubing string, or production tubing, is then run into the wellbore for providing fluid communication between the formation to the surface. The tubing string may be used to allow fluids from the surface to be pumped into the formation and/or to allow hydrocarbons in the formation to be produced at surface. Tubing strings comprise a plurality of generally axially (i.e., end-to-end) connected tubular elements, or "tubulars". The tubing string may also include one or more tools, or "tool subs", connected between adjacent tubular elements. Such tools may include valves, packers, etc., which aid in either the production of fluids (in particular hydrocarbon materials) entering the wellbore, or in stimulating a subterranean region proximal to the wellbore. Many such tools are known in the art.

In certain instances, activation of downhole tools requires temporarily pressurizing the lumen of the tubing string. This may be required, for example, for actuating hydraulically set packers. Various tools and methods are known for allowing the pressurization of a tubing string. One of such known tools is a burst disc, or rupture disc, sub. These tools comprise a generally tubular body having a frangible disc positioned perpendicularly to its longitudinal axis. The disc is positioned to block flow of fluid through the tool. Thus, once integrated into a tubing string, the burst disc sub blocks flow of fluids. It will be understood that the disc of the sub is selected according to the required pressure rating, i.e., its ability to withstand the pressure required to achieve the desired activation of other tools. To open the tool, the disc is ruptured, for which there are several known methods. In one instance, the pressure in the tubing string may be increased to beyond the tolerance of the disc to cause its rupture. Alternatively, rupturing of the disc may be accomplished by mechanically breaking the disc with a tool that is either run into the tubing string or one that incorporated into the sub and is activated by further pressurizing the tubing string. In these known methods, the disc is ruptured by applying a force in the direction of fluid flow, that is perpendicularly against the surface of the disc.

Examples of known burst disc subs are provided in US 2017/0002943, US 2009/0250226, US 2008/0271883, U.S. Pat. Nos. 11,808,109, 6,472,068, and 5,947,204. In some of these known devices, the frangible disc may be made of a glass or ceramic material.

The use of pressure for rupturing discs is often unpredictable since the discs may not always rupture at the expected pressures. The mechanical rupture methods often involve complicated tools or devices that add cost and time to the process. There exists a need to address at least one of drawbacks associated with the known burst disc subs.

SUMMARY OF THE DESCRIPTION

As described herein, there is provided a downhole tool comprising a generally cylindrical body comprising a top sub and a bottom sub and having a lumen extending therethrough, the tool being adapted to form a part of a tubing string, wherein:

- the top sub has a first end, adapted to be connected to an uphole component of the tubing string, and a second end;
- the bottom sub has a first end connected to the second end of the top sub and a second end adapted to be connected to downhole component of the tubing string.
- a piston provided coaxially within the bottom sub and having a first end a second end, the piston being adapted to be axially moveable within and relative to the bottom sub from a first position, wherein the piston is proximal to the first end of the bottom sub, to a second position, wherein the piston is moved in a direction towards the second end of the bottom sub;
- a severable retaining means for retaining the piston in the first position;
- a frangible disc provided adjacent to the first end of the piston and being adapted to prevent fluids from passing through the lumen of the tool; and,
- at least one breaking pin provided in an aperture extending through a wall of the piston and located adjacent the circumference of the frangible disc when the piston is in the first position, the at least one breaking pin being adapted to apply a radially inward force against the outer circumference of the frangible disc upon axial movement of the piston from the first position to the second position.

BRIEF DESCRIPTION OF THE FIGURES

The features of certain embodiments will become more apparent in the following detailed description in which reference is made to the appended figures wherein.

DETAILED DESCRIPTION

Figure 1:
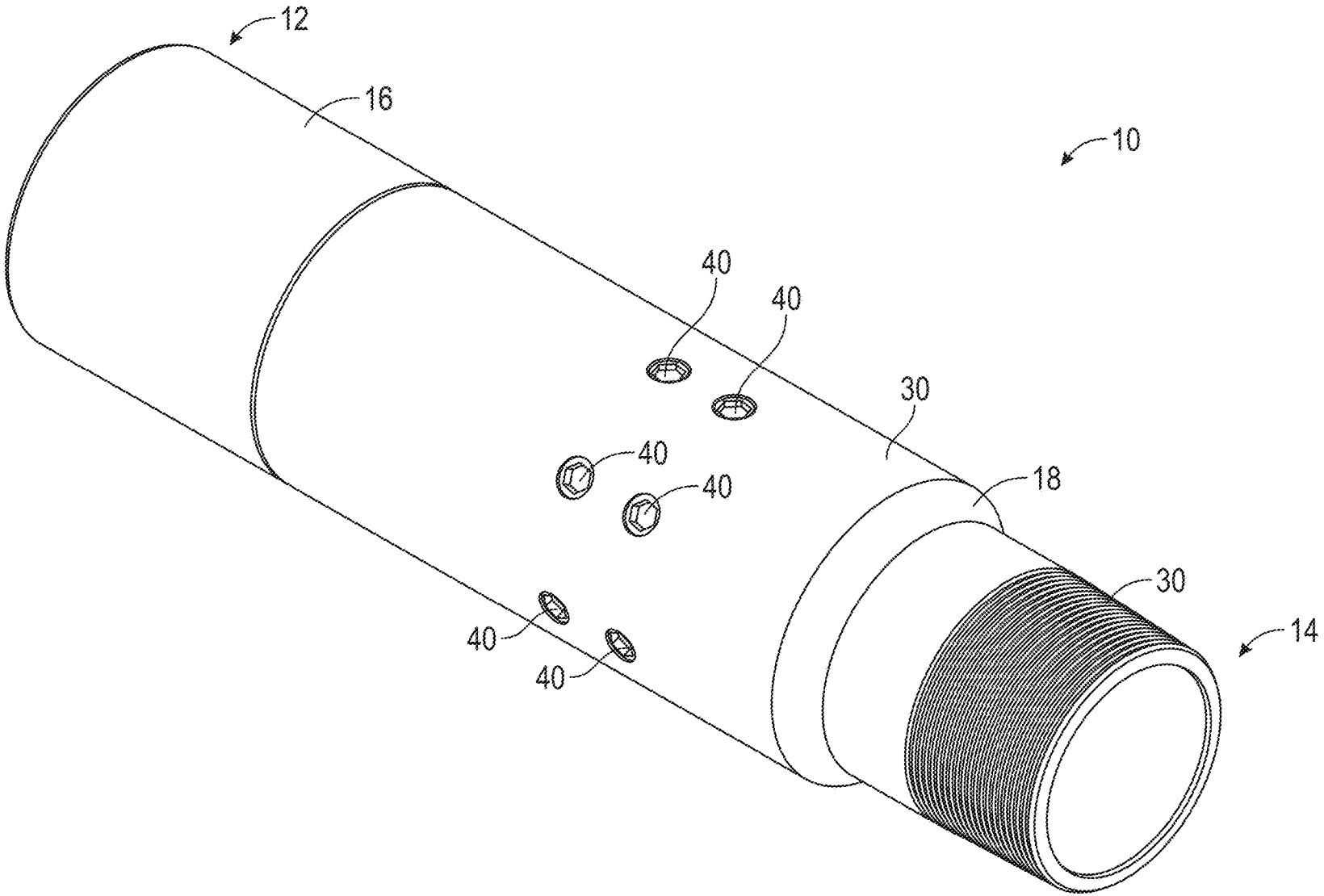
FIG. 1 is a side perspective view of the sub described herein according to one embodiment.

As used herein, the term "sub" will be understood to mean a tubing string component, such as a tubular member, a coupling, a tool etc. as known in the art. As also known, a sub has a generally cylindrical structure and is adapted to be connected to adjacent tubular members or other subs, when forming the tubing string. As with typical tubular members, a sub may have a female or "box" end and a male or "pin" end. The box end includes an internal threaded portion that is adapted to receive and threadingly engage an external thread provided on a pin end of an adjacent component (e.g., a tubular member, a sub, or a tool etc.). In this way, all components of the tubular string are connected together in an end-to-end manner. Alternatively, the ends of the sub may be the same (i.e., both may be a box, or both may be a pin), in which case the sub can be connected to adjacent components by means of a coupling.

The term "tool" as used herein will be understood to refer commonly known tubing string components that are used for performing various tasks. Examples of tools include valves, such as sliding sleeve valves, packers, liner hangers, etc.

The terms "top", "bottom", "up", or "down" may be used herein. It will be understood that these terms will be used purely for facilitating the description and, unless stated otherwise, are not intended in any way to limit the description to any spatial or positional orientation. In one example, the terms "top" or "uphole" may be used herein to refer to a direction or position along the tubing string or component that is towards or proximal to the surface. Similarly, the terms "bottom" or "downhole" may be used herein to refer to a direction or position along the tubing string or component that is towards or proximal to the bottom or "toe" of the well, i.e., away from the surface.

The terms "wellbore" or "borehole" may be used herein. These terms will be understood to mean a hole that extends from surface into a subterranean formation. The wellbore may in some instances be cased.

The terms "comprise", "comprises", "comprised" or "comprising" may be used in the present description. As used herein (including the specification and/or the claims), and unless stated otherwise, these terms are to be interpreted as open-ended terms and as specifying the presence of the stated features, integers, steps, or components, but not as precluding the presence of one or more other feature, integer, step, component or a group thereof as would be apparent to persons having ordinary skill in the relevant art. Thus, the term "comprising" as used in this specification means "consisting at least in part of". When interpreting statements in this specification that include that term, the features, prefaced by that term in each statement, all need to be present but other features can also be present. Related terms such as "comprise" and "comprised" are to be interpreted in the same manner.

The phrase "consisting essentially of" or "consists essentially of" will be understood as generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open-ended term, such as "comprising" or "including", it will be understood that direct support should be afforded also to "consisting essentially of" language as well as "consisting of" language as if stated explicitly and vice versa. In essence, use of one of these terms in the specification provides support for all of the others.

For the purposes of the present description and/or claims, and unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth herein are approximations that may vary depending upon the desired properties sought to be obtained by the present invention, inclusive of the stated value and has the meaning including the degree of error associated with measurement of the particular quantity. The term "about" generally refers to a range of numbers that one of ordinary skill in the art would consider as a reasonable amount of deviation to the recited numeric values (i.e., having the equivalent function or result). For example, this term "about" can be construed as including a deviation of +10 percent of the given numeric value provided such a deviation does not alter the end function or result of the value. Therefore, a value of about 1% can be construed to be a range from 0.9% to 1.1%.

The term "and/or" can mean "and" or "or".

Unless stated otherwise herein, the articles "a" and "the", when used to identify an element, are not intended to constitute a limitation of just one and will, instead, be understood to mean "at least one" or "one or more".

Figure 2:
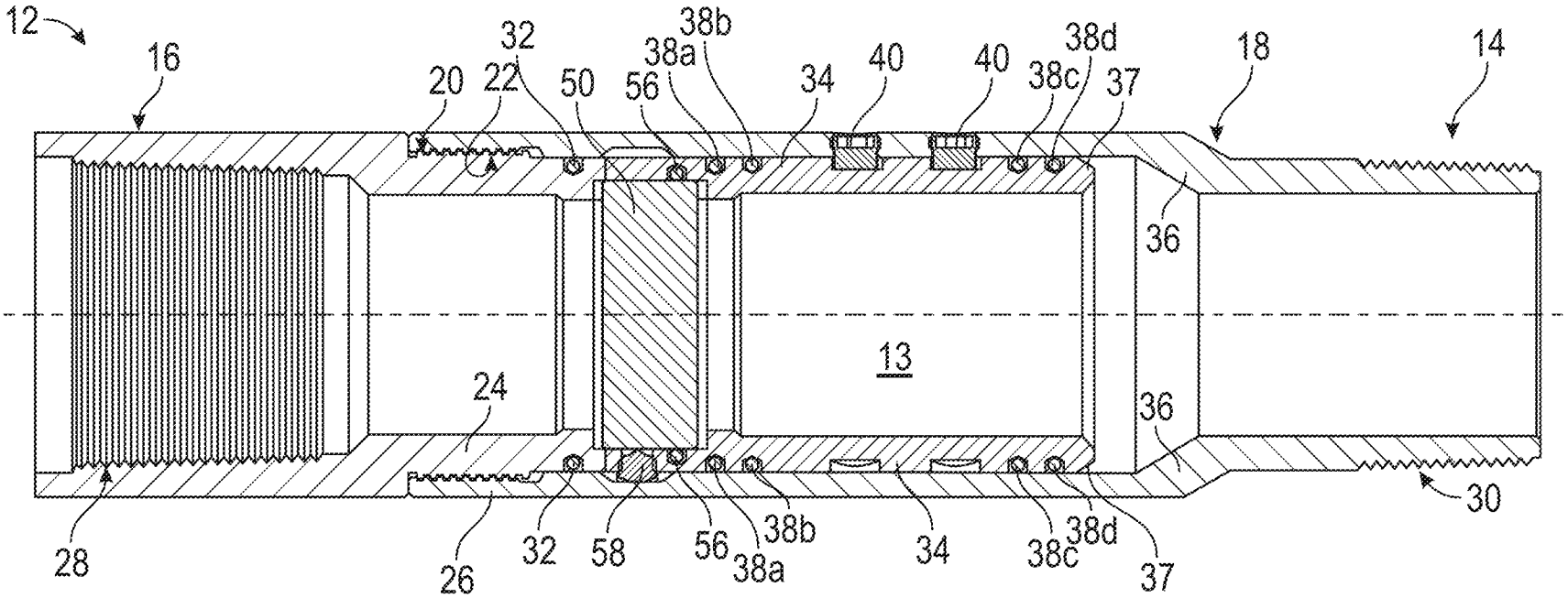
FIG. 2 is a side cross-sectional view of the sub of FIG. 1.

The present description relates generally to a downhole tool adapted for incorporation into a tubing string, wherein the tool comprises a burst disc sub. For the present description the term "sub" or "burst disc sub" will be used in reference to the subject tool. As illustrated in FIGS. 1 and 2, the burst disc sub 10 comprises a generally tubular body having a first, or uphole end 12 and a second or downhole end 14, and a lumen 13. The uphole end comprises a first portion, or "top sub" 16, while the downhole end comprises a second portion, or "bottom sub" 18. The lumen 13 serves to fluidly connect the sub 10 with the tubing string (not shown) when the sub 10 is actuated from an initial closed state to its open state, as described further herein.

The top sub 16 and bottom sub 18 are connected together by cooperating threaded portions shown at 20 (threads provided on the top sub 16) and 22 (threads provided on the bottom sub 18). More specifically, in the embodiment shown, the threads 20 of the top sub 16 are provided on a male or pin end 24 thereof, while the threads 22 of the bottom sub 18 are provided on a female of box end 26 thereof.

As known in the art, both the uphole 12 and downhole 14 ends are provided with threaded portions, 28 and 30, respectively, that allow for the sub 10 to be connected to tubulars when forming the tubing string. In the embodiment shown, the threaded portion 28 is provided on a box end of the top sub 16 and the threaded portion 30 is provided on a pin end of the bottom sub 18. As discussed above, this arrangement allows for the sub 10 to be connected to adjacent tubulars when forming the tubing string. As also discussed above, it will be understood that the present description is not limited to this particular arrangement. In general, it will be understood that the opposite ends 12 and 14 of the sub 10 will be designed to engage adjacent tubulars in any known manner.

As illustrated in FIG. 2, and as discussed above, the pin end 24 of the top sub 16 protrudes into and threadingly engages the box end of the 26 of the bottom sub 18. One or more seals, such as shown at 32 may be provided within a radial groove 33 formed on the outer surface of the pin end 24 in order to form a seal between the pin end 24 and the box end 26 of the bottom sub 18. As would be understood, the purpose of the seal 32 is to prevent fluids from passing in the interface of the pin end 24 of the top sub 16 and the box end 26 of the bottom sub 18. The seal 32 preferably comprises an O-ring, but any other seal may be used as would be known in the art to achieve the necessary fluid seal.

Figure 3:
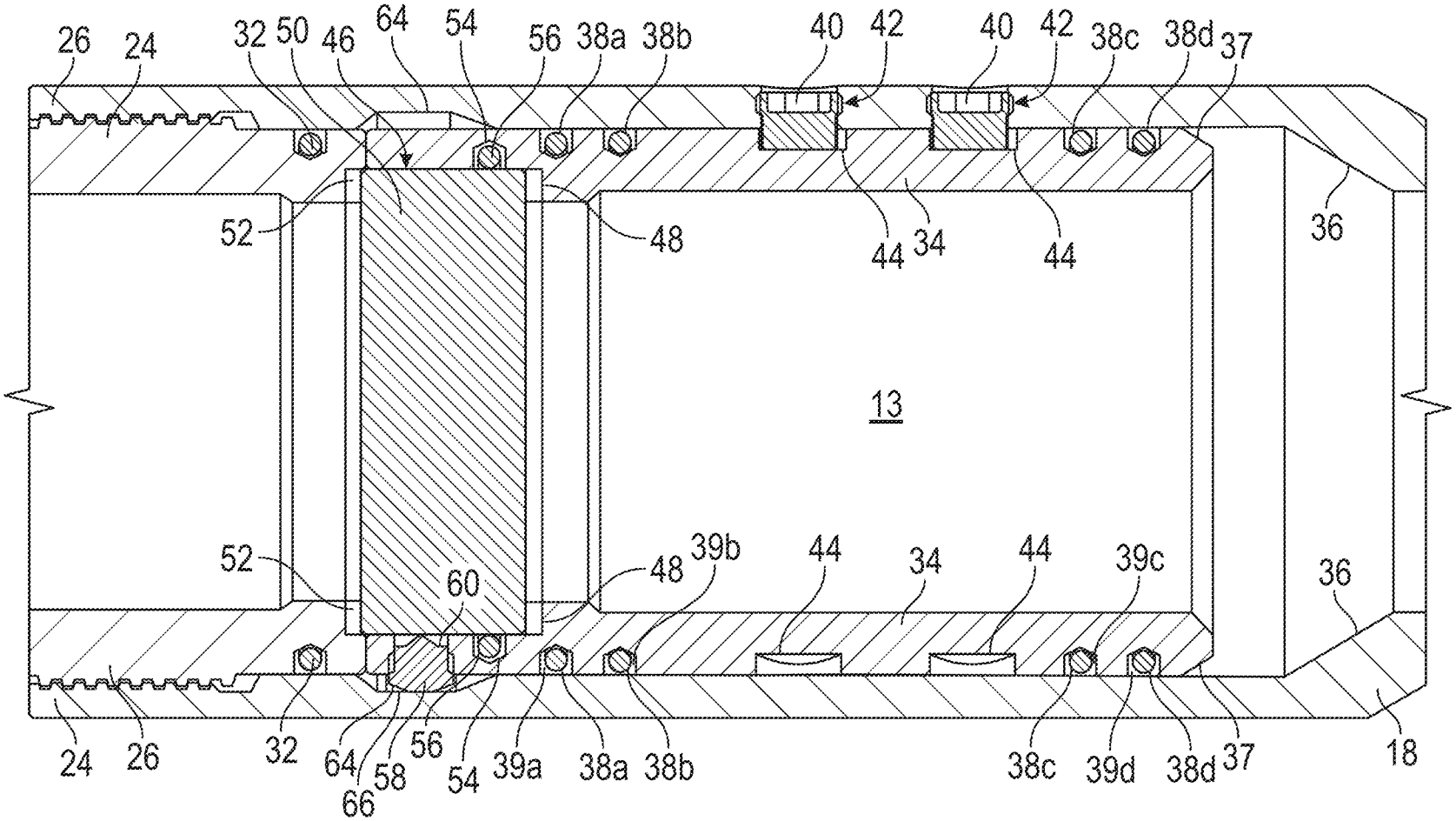
FIG. 3 is an enlarged view of a portion of FIG. 2.

The sub 10 further includes a piston 34 coaxially provided within the bottom sub 18 and adapted to be axially slidable within the bottom sub 18. More particularly, as illustrated in FIGS. 2 and 3 the piston 34 is provided between the pin end 24 of the top sub 16 and a throat, or region of reduced inner diameter of the bottom sub 18, provided proximal to the downhole end thereof. As shown, the throat forms a shoulder 36 on the inner surface of the bottom sub 18. The piston 34 has a downhole end 38 that is, in an initial state of the sub 10, axially separated from the shoulder 36. As described further below, the shoulder 36 is adapted to restrict the axial downhole movement of the piston within the bottom sub 18. In one embodiment, the shoulder 36 is tapered, as shown in FIGS. 2 and 3, to provide a gradually decreasing inner diameter moving from the uphole to downhole direction. In such embodiment, the downhole end 37 of the piston 34 may also be provided with a tapered outer diameter that is adapted to correspond with the taper of the shoulder 36, whereby further axial movement of the piston 34 within the bottom sub 18 is limited when downhole end 37 contacts the shoulder 36. It will be appreciated that the shoulder 36 of the bottom sub 18 and the downhole end 37 of the piston 34 may instead be non-tapered regions; however, the use of a tapered surface, particularly for the shoulder would be preferred to prevent a restriction to the flow of fluids there-through when the sub 10 is opened.

One or more seals, such as shown at 38*a* to 38*d* (collectively referred to as 38) in FIGS. 2 and 3, are provided within respective radial grooves 39*a* to 39*d* provided on the outer surface of the piston in order to form one or more seals at the interface between the piston and the bottom sub 18. As would be understood, the purpose of the seals 38 is to prevent fluids from passing in the interface of the piston 34 and the bottom sub 18. For this purpose, the seals 38 preferably comprise O-rings, but any other seal may be used as would be known in the art to achieve the necessary fluid seal.

A plurality of shear pins 40 are provided in apertures 42 extending through the wall of the bottom sub 18 and adapted to be engaged within respective radial grooves 44 provided on the outer surface of the piston 34. In the initial state of the sub 10, as illustrated in FIGS. 2 and 3, the shear pins 40 serve to retain the piston 34 in the position shown, that is, proximal to the uphole end of the bottom sum 18 and axially separated from the shoulder 36.

In the embodiment shown, the shear pins 40 are generally circumferentially spaced over the sub 10 and arranged in two bands. In the illustrated embodiment, each band includes seven shear pins. It will, however, be understood that in other embodiments, any number of shear pins and/or bands of shear pins may be provided. The present description is not limited to the number or arrangement of shear pins. The illustration of the shear pins 40 in FIG. 1, for example, is shown on one side of the sub 10 only for convenience. In another embodiment, as shown for example in FIG. 7, the shear pins 40 can be provided at any location around the circumference of the sub. As noted above, and as will be understood by persons skilled in the art in view of the present description, the purpose of the shear pins is to retain the sub 10 in the initial state until a desired pressure condition is reached (as described further herein).

The uphole end of the piston 34 is provided with a region of increased inner diameter, thus forming a pocket 46 having a seat, or recess 48. The sub 10 included a frangible disc 50 received within the pocket 46, which may also be described as a disc retaining space.

The downhole end of the top sub 16 includes a corresponding recess 52 that is adapted to receive a portion of the frangible disc 50.

Figure 7:
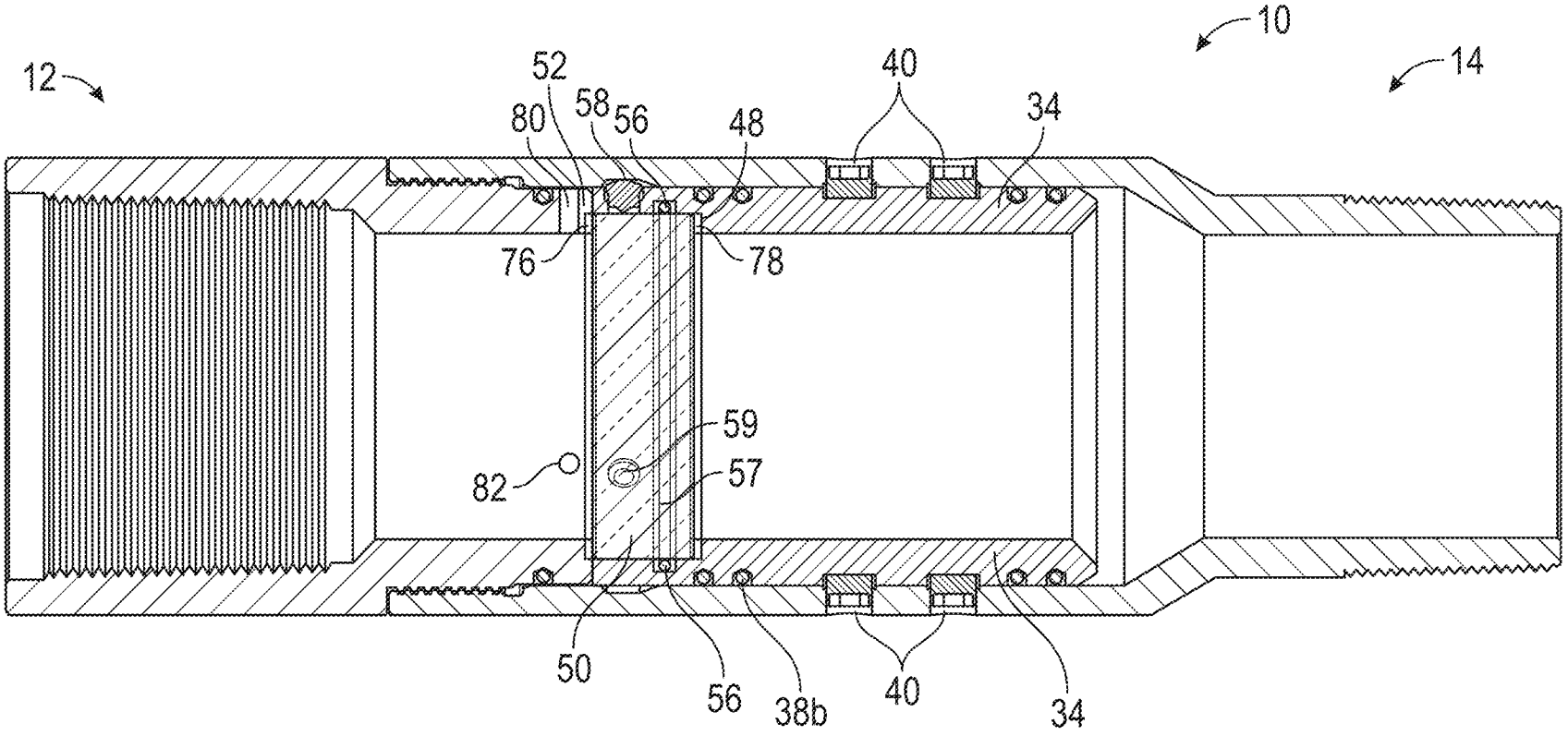
FIG. 7 is an enlarged view of a portion of FIG. 2 showing the sub in an initial state according to another embodiment.

As illustrated in FIGS. 2 and 3, in the initial state of the sub 10, that is when it is run into the wellbore, the downhole end of the top sub 16 and the uphole end of the piston 34 are in a generally abutting arrangement and retained in such arrangement by the engagement of the shear pins 40 and the piston 34. In this arrangement, the frangible disc 50 is retained within the recess 52 of the top sub 16 and the pocket 46 of the piston. In one embodiment, as illustrated, the frangible disc may be smaller in axial length than the axial length of the disc space formed by the top sub recess 52, and the pocket 46 and seat 48 of the piston 34. It will be understood that this arrangement allows a degree of clearance between the disc 50 and the opposed recess 52 and seat 48, thereby ensuring that the top sub 16 and piston 34 are in abutting arrangement. In a further embodiment, such as illustrated in FIG. 7, spacer rings may be provided to separate the glass disc 50 from the metal walls of the recess 52 and seat 48.

The pocket 46 preferably further includes a radial groove 54 provided on the inner surface thereof that is adapted to receive a seal 56, such as an O-ring or the like. As shown in FIGS. 2 and 3, the groove 54 is positioned at an axial location that ensures that a seal is formed with the outer edge surface of the disc 50 (i.e., at a region of the disc perimeter) to prevent fluids from flowing there-past. In one embodiment, the outer edge of the disc may be provided with a corresponding circumferential groove to receive the seal 56. This embodiment is illustrated, for example, in FIG. 7 where a circumferential groove 57 is provided on the out edge of the glass disc 50 to accommodate the seal 56. This embodiment of the disc is discussed further below.

Figure 4:
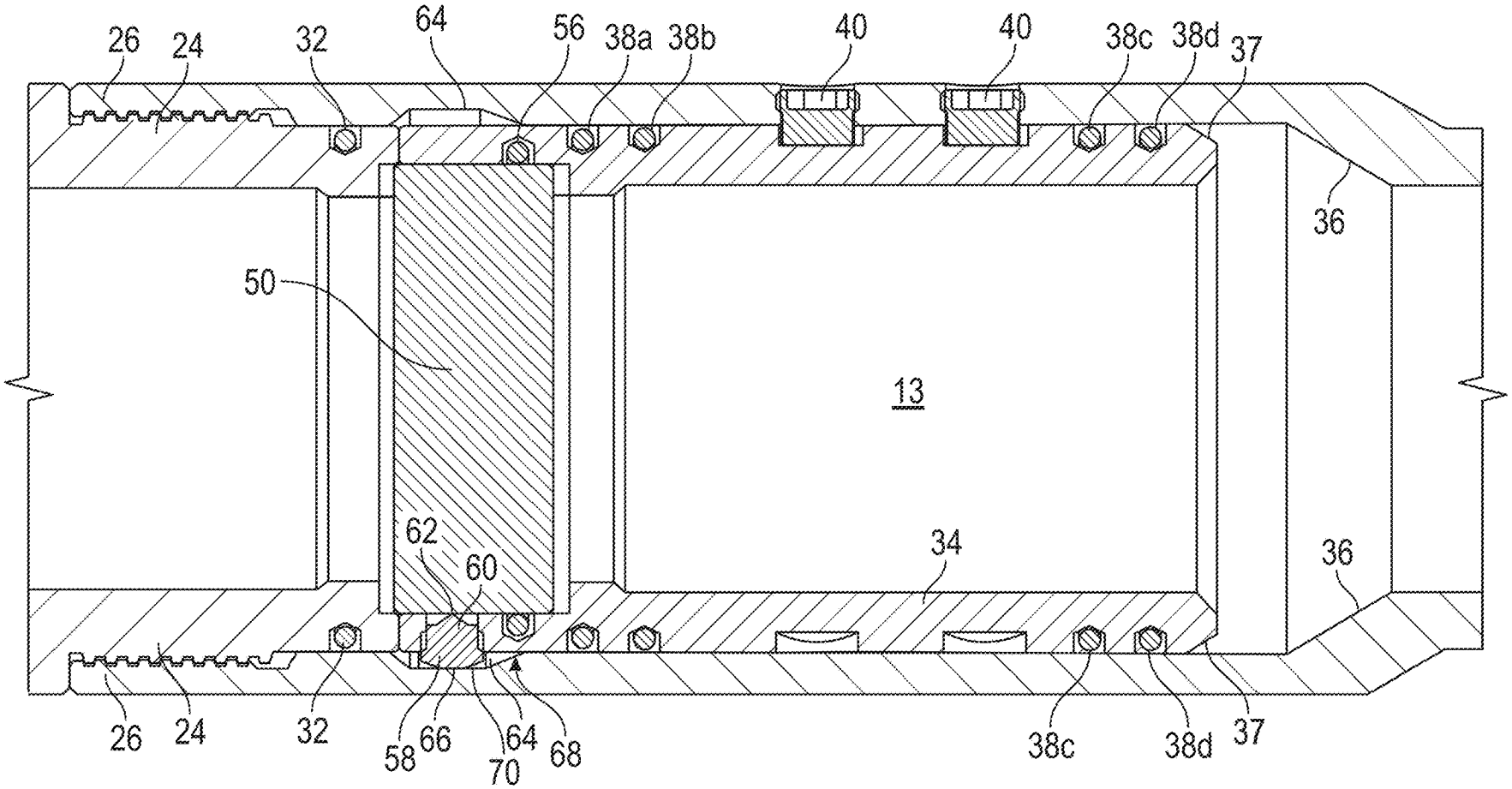
FIG. 4 is a further enlarged view of a portion of FIG. 2 showing the sub in an initial or closed (run-in) state.

As illustrated in FIGS. 3 and 4, in the initial or run-in state of the sub 10, the frangible disc 50, in combination with the seals 56, 32, and 38, prevent fluids from passing through the sub 10. Thus, the sub 10 is in a closed state. As will be understood by persons skilled in the at, the disc 50 and the shear pins 40 are adapted to allow the sub 10 to remain in this close state until a preset pressure is reached uphole of the disc 50.

Figure 5:
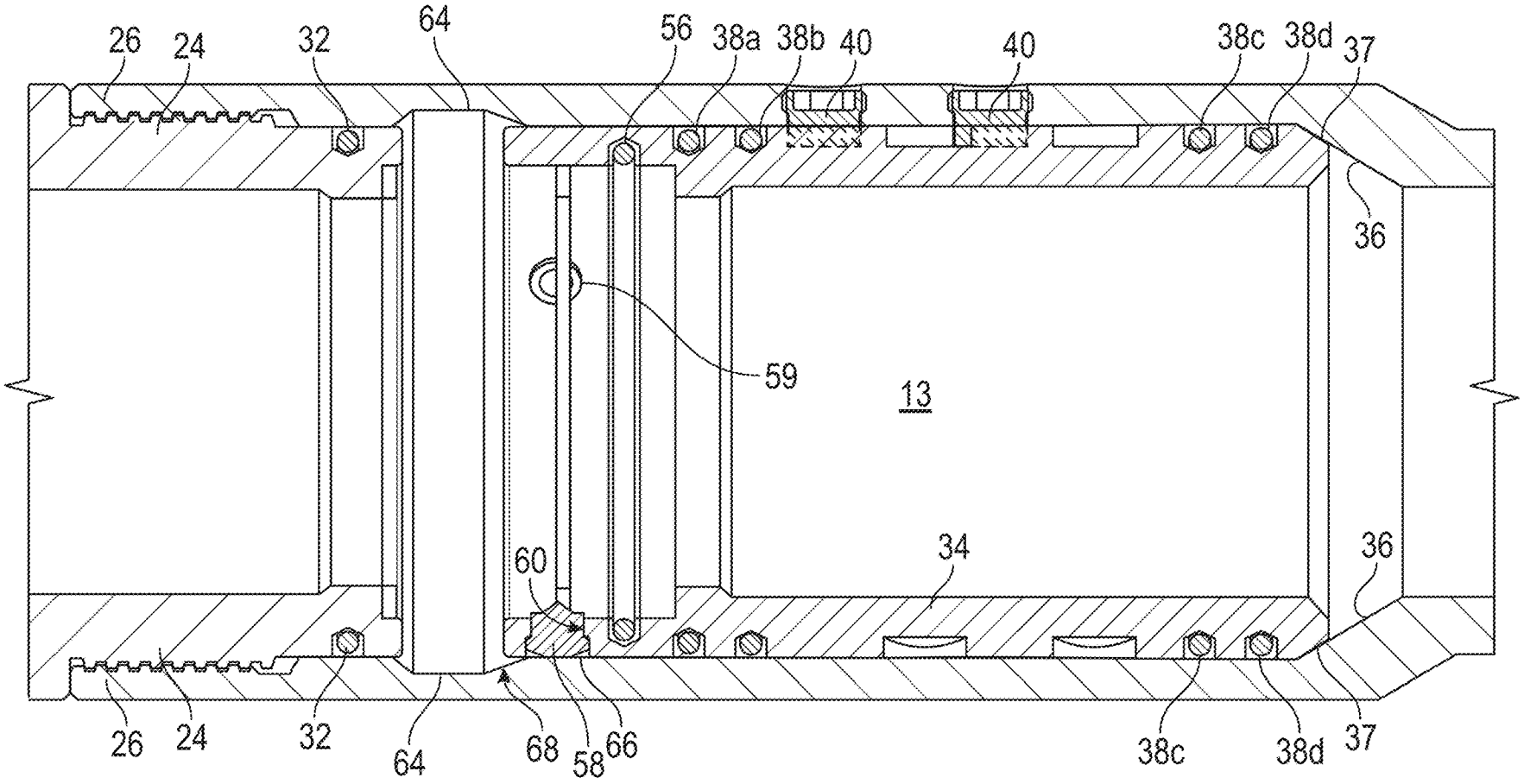
FIG. 5 is an enlarged view of a portion of FIG. 2 showing the sub in an actuated or open state.

The actuation of the sub 10 from closed to open states is illustrated in FIGS. 4 and 5. In the closed (initial) state, the shear pins 40 are intact and the piston 34 is thus retained in an uphole position adjacent the pin end 24 of the top sub 16. As shown in FIG. 4, the sub 10 is further provided with at least one breaking pin 58 that is positioned within an aperture 60 extending through the wall of the uphole end of the piston 34. As described further below, the aperture 60 is sized to provide the breaking pin 58 with a clearance to allow the breaking pin to move radially inwards further into the aperture 60. In one embodiment, several breaking pins 58 are provided on the sub 10, each being circumferentially separated. By way of example, FIG. 5 illustrates a further breaking pin at 59. In one embodiment three such pins may be provided. For convenience, the present description will refer to breaking pin in the singular; however, it will be understood that the description is not limited to any number of breaking pins or associated apertures.

Figure 6:
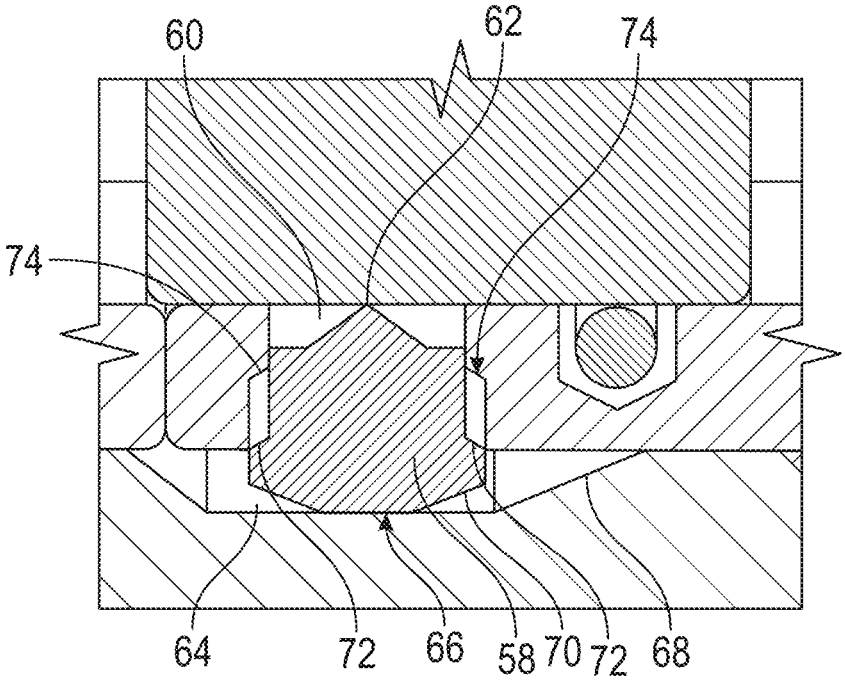
FIG. 6 is a partial enlarged view of the sub of FIG. 4 illustrating the breaking pin and associated recess.

As shown in FIGS. 4 and 6, the radially inward portion, or first end 62, of the breaking pin 58 comprises, in one embodiment, a profile that is preferably adapted to apply a concentrated force against the frangible disc 50 so more efficiently cause shattering of the disc. In one example, the first end 62 of the breaking pin 58 has the profile of a pin or blade or other sharp shape that is positioned facing the frangible disc 50. As would be understood by persons skilled in the art, such a sharp edge of the first end 62 serves to concentrate the inward force on a smaller surface area of the edge of the frangible disc 50, thus enhancing the applied force to more efficiently cause breakage or shattering of the disc. As would also be understood, the breaking pin 58 would be preferably formed from a high-strength material that exhibits higher mechanical strength characteristics than the frangible disc 50 so that the inward force is translated from the breaking pin to the disc. In one embodiment, the breaking pins may be formed from a carbide material.

As also shown in FIGS. 4 and 6, the box end 26 of the bottom sub 18 is provided with a radial groove 64 for receiving the radially outward end 66 of the breaking pin 58. As will be understood from the present description, by providing such a radial groove 64, the sub 10 may be provided with any number of breaking pins 58 (i.e., one or more breaking pins) that may be circumferentially spaced over the outer surface of the piston 34. The present description is not limited to any particular number of breaking pins.

The breaking pin 58 and radial groove 64 are adapted to cooperate in such a way as to urge the breaking pin 58 to move radially inward as the piston 34 is moved in the downhole direction with respect to the bottom sub 18. For this purpose, the groove 64 is provided with a radially inwardly tapered ramp 68 at the downhole end thereof. Similarly, the breaking pin 58 is provided with a corresponding radially inwardly tapered ramp 70 also at the downhole end thereof.

As shown more clearly in FIG. 6, the breaking pin 58 may preferably comprise a shoulder 72 formed as a result of difference in dimension, such as a diameter, between a smaller first end of the pin, that is the end closest to the frangible disc 50, and a second end of the pin, that is the end closest to the bottom sub 18. The aperture 60 of the piston is provided with a corresponding shoulder 74. As can be seen in comparing FIGS. 4 and 6 with FIG. 5, as the piston 34 is axially moved in the downhole direction, thus causing the radially inward movement of the breaking pin 58, such radially inward movement of the pin is limited when the shoulders 72 and 74 come into contact. It will be understood that this arrangement serves to prevent the breaking pin 58 from passing through the aperture 60 and entering into the lumen of the sub 10.

In operation, and starting from the initial closed state of the sub 10 as seen in FIGS. 2 to 4 and 6, the frangible disc 50 serves to prevent fluids from passing through the sub 10, as discussed above. In this state, the breaking pin 58 is positioned proximal to the radius of the frangible disc 50 and within the aperture 60 and groove 64. In this state, the shear pins 40 prevent relative axial movement between the piston 34 and the bottom sub 18. When opening of the sub 10 is desired, pressure uphole of the sub is increased, which in turn applies a force in the downhole direction against the disc 50 and, thereby, the piston 34. Pressure is then increased to a level beyond the tolerance of the shear pins 40, which caused shearing of the shear pins 40 and, thereby, the axial shifting of the piston 34, with respect to the bottom sub 18, in the downhole direction.

As can been in comparing FIGS. 4 and 5, as the piston 34 is urged in the downhole direction with respect to the bottom sub 18, the breaking pin 58, which is positioned within the recess 64 in the piston 34, is also moved in the downhole direction. As the ramp 70 of the breaking pin 58 interacts with the corresponding ramp 68 of the groove 64, the breaking pin 58 is urged radially inwardly, thereby applying a force against the frangible disc 50. As pressure uphole of the sub 10 is further increased, the force applied by the breaking 58 against the frangible disc 50 increases up until a threshold value at which point fracture of the disc 50 is achieved. Upon fracturing of the disc 50, as shown in FIG. 5, the sub 10 is actuated into its open state, wherein fluid are free to pass there-through.

As shown in FIG. 5, the axial movement of the piston 34 with respect to the bottom sub 18 is limited upon the downhole end of the piston 37 contacting the shoulder 36 of the bottom sub 18.

In one preferred embodiment, the frangible disc 50 is formed of a brittle material that is subject to shattering upon application of a radially inward force, as would be applied by the breaking pin 58. One example of such brittle material is tempered, or pre-stressed glass. As known in the art, the tempering process provides the glass with greatly increased mechanical strength, in particular to forces applied normal to the plane of the glass. This is the result of the energy stored in the glass during the tempering or stressing process. However, tempered glass is also susceptible to shattering when a force is applied perpendicularly to the plane of the glass or when a sufficient force is applied to cause breakage (as would occur with the breaking pin 58). The shattering of the glass disc is also preferable for the present use as it does not lead to the accumulation of large pieces of the disc as would occur with other materials (such as a ceramic material or the like). Although the use of tempered glass is preferred for use as the frangible disc 50 of the sub 10, it will be understood that the disc may be made of any other material known in the art that is subject to breakage particularly upon application of a radially inward force as would be applied by the breaking pin 58.

FIG. 7 illustrates another embodiment of the sub 10, where like elements are identified with like reference numerals. As mentioned above, FIG. 7 illustrates an embodiment wherein the disc 50 is provided with a circumferential groove 57 on the outer edge thereof to accommodate, or receive, the seal 56. It will be appreciated that provision of the circumferential groove 57 aids in ensuring that the seal 56 is accurately engaged and that the disc 50 is positioned at a desired position within the sub 10. Although shown with respect to the embodiment of FIG. 7, it will be understood that the circumferential groove 57 may be provided on a disc used with any other embodiment, such as the embodiment shown in FIG. 1.

As noted above, FIG. 7 illustrates another embodiment, wherein first and second spacer rings 76 and 78, respectively, are provided on opposite sides of the disc 50. As shown, first spacer ring 76 is provided within the recess 52 and second spacer ring 78 is provided within the seat 48. As would be understood, the spacer rings serve to separate the glass disc 50 from the metal surfaces of the recess 52 and seat 48. For this purpose, the spacer rings are preferably made of a non-metal material, which, for example, may be a polymer material. It will be appreciated that the material forming the spacer rings would be chosen to tolerate the temperature and pressure conditions associated with downhole applications. In one example, the spacer rings may be made of a thermoplastic material such as polyether ketone (PEEK).

In certain situations, while the disc 50 is still intact, the pressure downhole of the disc 50 (i.e., to the right of the disc 50 as shown in the figures) may be greater than the pressure uphole of the disc. This would result in the disc 50 being urged against the recess 52. As would be understood, this reduces the uphole-facing surface area of the disc 50 that is exposed to an applied pressure. As would be appreciated, such reduction in exposed surface area would result in a higher pressure demand to actuate the sub 10. To minimize this effect, and as illustrated in FIG. 7, one embodiment of the sub 10 includes one or more pressure release ports as shown, for example, at 80 and 82. Although two ports are shown in FIG. 7, it will be understood that any number of such ports may be provided, each preferably being circumferentially spaced from each other.

Figure 8:
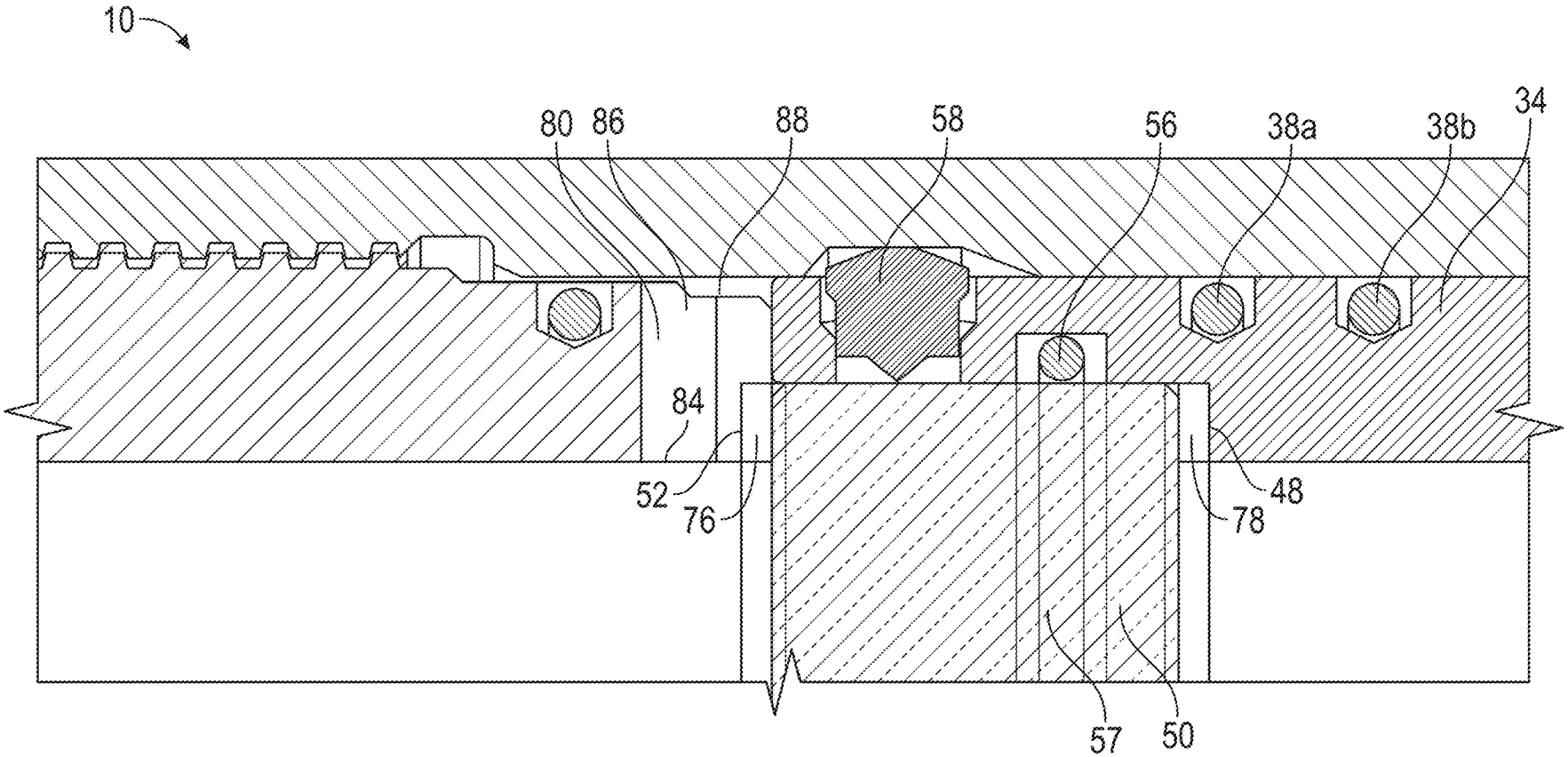
FIG. 8 is a partial enlarged view of the sub of FIG. 7.

FIG. 8 illustrates an enlarged portion of the sub to further illustrate the port 80. As shown, the port 80 has a first end 84 that opens into the lumen of the sub 10, and a second end that opens into an annular space 88 that is in fluid communication with the uphole outer circumferential surface of the disc 50. In this way, a pressure leak path is formed between the uphole lumen of the sub 10 and the outer circumference of the disc 50. As will be understood, as the pressure in the uphole portion of the sub 10 is increased, the pressure will be applied against the exposed uphole surface of the disc 50, as discussed above. However, with the aforementioned leak path, such pressure is also able to be applied against the outer circumference of the disc 50. In this way, the applied pressure acts upon the entire surface area of the disc 50 thereby avoiding the problem mentioned above.

As will be appreciated, from the present description, the inventors have developed a unique burst disc sub that provides an efficient means of actuating the tool to cause opening thereof when needed. It will also be appreciated the inventors have also developed a unique method of operating a burst disc sub that comprises the application of a radial mechanical force on a frangible disc as opposed to an axial force. Such method is discussed above. By providing a frangible disc made of a brittle material, as discussed above, the application of a radial force results in shattering of the frangible disc into numerous small pieces thus avoiding the problems associated with known tools and methods.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating the subject matter described herein and are not intended to be drawn to scale or to be limiting in any way. The scope of the claims appended hereto should not be limited by the preferred embodiments set forth in the above description but should be given the broadest interpretation consistent with the present specification as a whole. The disclosures of all references in the present description herein are incorporated herein by reference in their entirety.

We claim:

1. A downhole tool comprising a generally cylindrical body comprising a top sub and a bottom sub and having a lumen extending therethrough, the tool being adapted to form a part of a tubing string, wherein:

the top sub has a first end, adapted to be connected to an uphole component of the tubing string, and a second end;

the bottom sub has a first end connected to the second end of the top sub and a second end adapted to be connected to downhole component of the tubing string;

a piston provided coaxially within the bottom sub and having a first end a second end, the piston being adapted to be axially moveable within and relative to the bottom sub from a first position, wherein the piston is proximal to the first end of the bottom sub, to a second position, wherein the piston is moved in a direction towards the second end of the bottom sub;

a severable retaining means for retaining the piston in the first position;

a frangible disc provided adjacent to the first end of the piston and being adapted to prevent fluids from passing through the lumen of the tool; and, at least one breaking pin provided in an aperture extending through a wall of the piston and located adjacent the circumference of the frangible disc when the piston is in the first position, the at least one breaking pin being adapted to apply a radially inward force against the outer circumference of the frangible disc upon axial movement of the piston from the first position to the second position.

2. The downhole tool of claim 1, wherein the frangible disc is retained in a disc retaining space formed at least by a first recess provided in the piston.

3. The downhole tool of claim 2, wherein the disc retaining space is further formed by a second recess provided in the second end of the top sub.

4. The downhole tool of claim 3, wherein the first recess and second recess are provided with respective spacer rings, and wherein the frangible disc is provided between the spacer rings.

5. The downhole tool of claim 1, wherein the severable retaining means comprises one or more shear pins connecting the bottom sub to the piston.

6. The downhole tool of claim 1, wherein the at least one breaking pin comprises a first end proximal to the frangible disc and provided with a profile adapted to apply a force against the frangible disc.

7. The downhole tool of claim 6, wherein the second end of the at least one breaking pin is received within a circumferential groove provided in the wall of the bottom sub.

8. The downhole tool of claim 7, wherein the circumferential groove comprises a ramped surface and the second end of the at least one breaking pin includes a corresponding ramped surface, whereby, upon movement of the piston from the first position to the second position, the ramped surface of the breaking pin engages the ramped surface of the groove thereby forcing the at least one breaking pin to move radially inwardly.

9. The downhole tool of claim 1, wherein the aperture includes a shoulder to prevent the at least one breaking pin from passing therethrough and entering the lumen of the tool.

10. The downhole tool of claim 1, wherein the second end of the piston comprises a shoulder and wherein the bottom sub comprises a corresponding shoulder, whereby axial movement of the piston is limited upon engagement of the shoulder of the piston with the shoulder of the bottom sub.

11. The downhole tool of claim 1, wherein the frangible disc is made from a brittle material.

12. The downhole tool of claim 1, wherein the frangible disc is made from tempered glass.

13. The downhole tool of claim 1, wherein the second end of the top sub is provided with at least one pressure relief port, wherein the at least one pressure relief port comprises a first opening into the lumen of the tool uphole of the frangible disc, and a second opening fluidly connected to a flow path in fluid communication with an outer circumferential edge of the frangible disc.

* * * * *